US005158137A

United States Patent [19]

Kim

[11] Patent Number: 5,158,137

[45] Date of Patent: Oct. 27, 1992

[54] RETRIEVABLE OIL WELL CAPPING DEVICE

[75] Inventor: Hilton S. Kim, Los Angeles, Calif.

[73] Assignee: Hilton & Chris Enterprises, Los Angeles, Calif.

[21] Appl. No.: 709,590

[22] Filed: Sep. 30, 1991

[51] Int. Cl.[5] ..... E21B 33/128

[52] U.S. Cl. ..... 166/72; 166/191; 166/196; 166/387; 166/85

[58] Field of Search ..... 166/85, 78, 124, 139, 166/191, 196, 181, 387, 192

[56] References Cited

U.S. PATENT DOCUMENTS

| | | | |
|---|---|---|---|
| 546,258 | 10/1895 | Suverkrop | 166/196 |
| 677,796 | 7/1901 | Preslar | 166/192 |
| 1,395,718 | 11/1921 | Mack | 166/196 |
| 1,811,407 | 6/1931 | Skelly | 166/85 X |
| 1,822,140 | 9/1931 | Gallaher | 166/85 |
| 2,244,076 | 6/1941 | Moe | 166/192 |
| 2,851,108 | 9/1958 | Reed | 166/139 |
| 3,085,627 | 4/1963 | Sodich | 166/212 X |
| 3,165,918 | 1/1965 | Loomis | 166/196 |
| 3,420,307 | 1/1969 | Conrad | 166/196 X |
| 3,561,529 | 2/1971 | Owen | 166/196 |
| 4,408,662 | 10/1983 | Shearhart | 166/139 X |
| 4,411,314 | 10/1983 | Shearhart | 166/124 |
| 4,967,846 | 11/1990 | Wood | 166/387 |

*Primary Examiner*—Stephen J. Novosad
*Attorney, Agent, or Firm*—John Holtrichter, Jr.

[57] ABSTRACT

The invention is an oil well capping device that may be forced into an oil well casing through which oil and/or gas under high pressure is emanating, to temporarily completely obstruct the flow of such oil until repairs to the well head structure have been completed before the device is removed, and includes a well sealing arrangement utilizing an axial compression system that causes elastomeric material elements mounted on an elongated shaft to radially expand and temporarily and safely seal off the well casing.

30 Claims, 3 Drawing Sheets

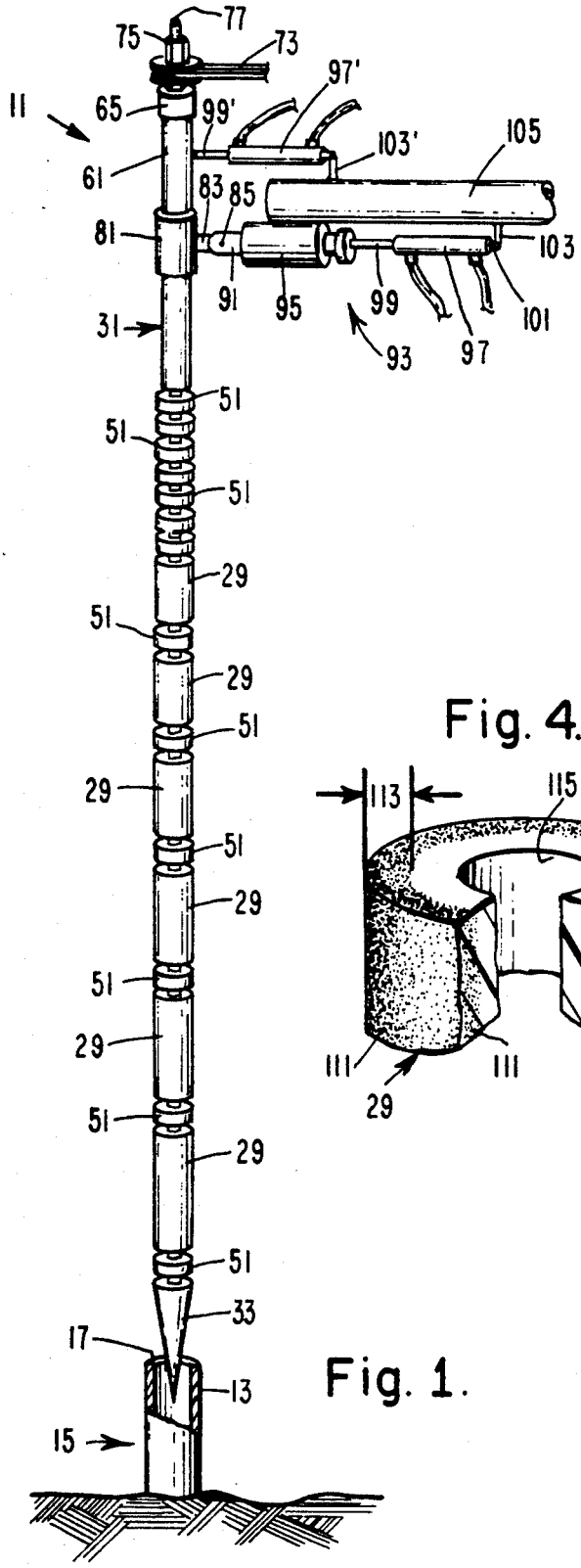
Fig. 1.
Fig. 3.
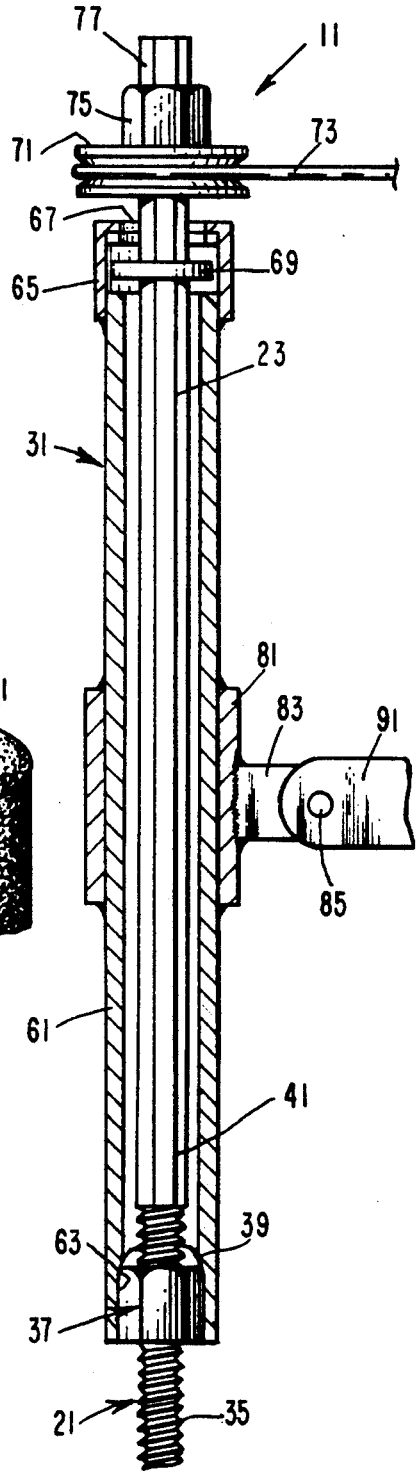
Fig. 4.
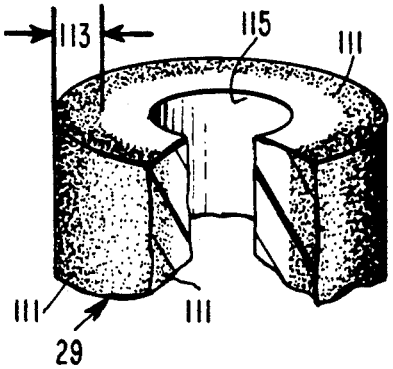

Fig. 5.
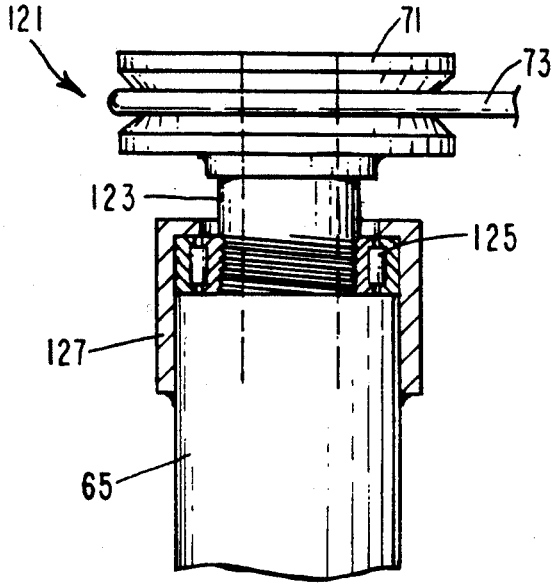
Fig. 8.
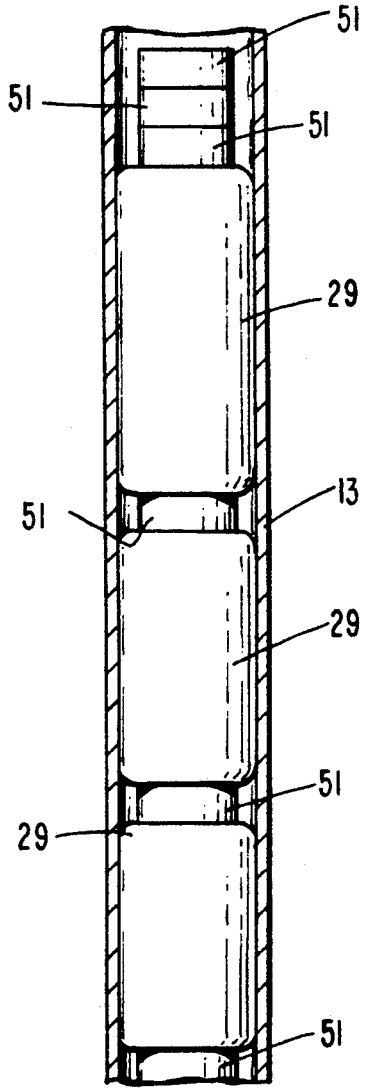
Fig. 9.
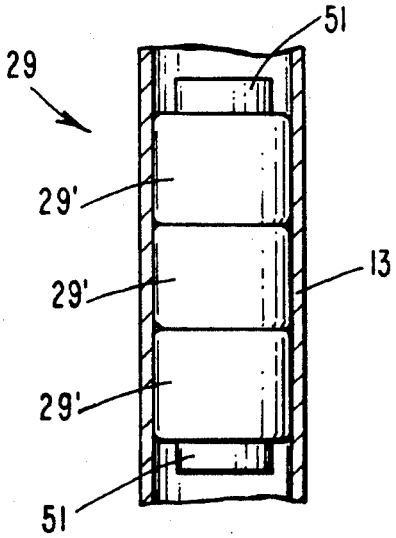
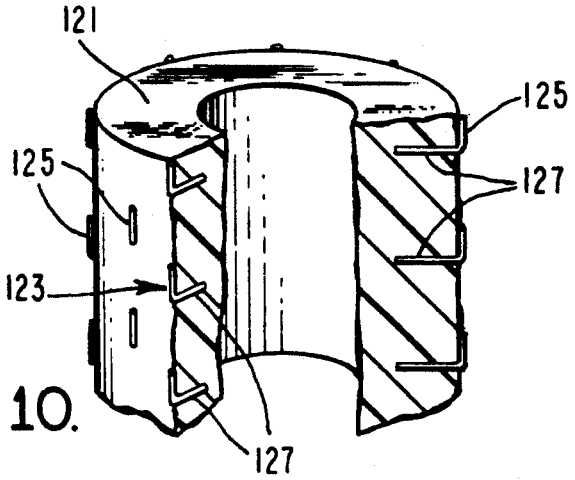
Fig. 10.

RETRIEVABLE OIL WELL CAPPING DEVICE

BACKGROUND

The present invention relates to capping apparatus and more particularly to a capping device that is retrievable from high pressure oil wells once its well obstructing function is no longer needed.

The danger of an accidental explosion and accompanying combustion of combustible liquids and gases at oil and gas well sites has been recognized for many years. These explosions and resulting fires have occurred with some frequency ever since the first oil and natural gas wells were drilled. The problem has become particularly acute with the advent of drilling techniques which allowed deeper wells that tapped combustible fluids under greater pressure.

As a consequence of most of these explosions is the damage to the well head structures, including the valving necessary to control the fluid pressure and volume, The above described problem has recently become suitable storage area. The above described problem has recently become acerbated by the intentional destruction of well heads by the use of explosives, in the middle East.

After careful consideration of the above-noted conditions, the inventor herein has developed a new and improved retrievable oil well capping device that may be lifted over and deposited in a high pressure well, and thereafter remotely controlled to temporarily completely obstruct the well casing without damage to the well in order to allow the well head structure to be repaired or replaced.

The inventor's new technique utilizes a radially expansive material that expands under axial compression in a manner that safely obstructs a well casing progressively from one end of the material to the other.

The prior art solutions to the above-noted problems have also been investigated. For example, in U.S. Pat. No. 546,258, there is disclosed a removable tube or pipe stopper disposable in Artesian or Driven Wells, including an upwardly-pointing cone fixed at the lower end of an interior hollow tube movably coaxially disposed within an exterior tube. An elastic sleeve is disposed over the exterior tube and held axially in place at the lower end of the tube by a collar. As a sleeve nut threadably engaged to the interior tube, at the upper end of the device, is rotated, the tube is drawn upwardly to force the cone into the bottom of the elastic sleeve. This forces the elastic material to engage the inner wall of the well to force any fluid flow to go through the tube that has a stop cock at its upper end.

U.S. Pat. No. 1,395,718 discloses an oil well packer that is placed in a well to be permanently capped and includes an elongated cylindrical body that is driven downwardly by impact on its cap to ratchet spring-loaded dogs downwardly along engaging teeth in an elongated bore of a sleeve at the bottom of the device. Just below the cap, and again lower in the unit, is an annular outwardly-pointing compressible member separated from an annular, generally inwardly-pointing compressible member, by an annular rigid disk. Therebelow, are alternately disposed annular outwardly-pointing rigid members and compressible member. Below the second compressible member is an inclined surface annular ridged wedge member that is separated from the lower wedge member by a rigid slip member.

As pounding continues on the cap, the dogs are ratcheted downwardly in the sleeve to lessen the distance between the upper edge of this sleeve and the inclined shoulder of the cap. This compresses the members to be forced inwardly against the body to form a seal, while the members are forced outwardly against the wall of the well.

U.S. Pat. No. 3,165,918 shows a well tool testing device adapted to be inserted into plastic-lined well pipe or the like to test the same for leaks by the application of a fluid under pressure. The tool has an external surface coated with a material which is softer than the plastic lining in the well pipe whereby accidental contact of the tool with the plastic lining of the well pipe does not abrade or scratch the same. The device is inserted into a well pipe. Rubber packer elements are positioned on opposite sides of the formed well joint to be tested and fluid under pressure is then caused to flow through a conduit into the testing device to cause the resilient packers to expand into sealing engagement with the well pipe and thereby seal off the section of well pipe to be tested. Pressure of the hydraulic fluid flowing into the testing device is then increased to the desired test pressure and the hydraulic test fluid flows into the sealed off section externally of the testing tool and applies this pressure to the well pipe.

U.S. Pat. No. 3,561,529 teaches a through-tubing non-retrievable bridge plug that includes telescoping tubing sections, with respectively decreasing diameters. Each such section has an equal length axially extending slot, and a second set of like slots. Each of these slots are staggered so that no two adjacent slots overlap. A central tubular section is disposed axially through the center of the bridge plug and extends beyond the upper and lower axial ends of the tubing sections. The lower end of the central tubular section is attached at its lower end to a valve housing, while, when the section is rotated first pulls the innermost section axially upwardly with respect to the outer sections, the slotted portions of the telescoping tubing sections are forced radially outwardly to engage and lock to the surrounding well structure.

U.S. Pat. No. 4,411,314 concerns a tool for insertion and retrieval of a casing packer, the packer having a body, slips 16 that hold the packer in place, packing gland of elastomeric material that seals the interior of a casing, and resilient drag springs that extend from the body to engage the interior of the casing. To set the packer, tubing is rotated to first radially extend the slips to engage the interior casing wall and lock it in place. Further rotation in the same direction causes the packing gland to expand outwardly to seal the interior of the casing.

From the foregoing it should be clear that none of the prior art techniques provide the expandable well casing sealing means of the invention which safely obstructs the well casing progressively along an elastomeric material from one end of the material to the other.

Thus, it should be recognized that a device that is relatively easily disposed over and into a very high pressure gushing oil well, even where the well head structure is somewhat damaged, and that safely and temporarily completely obstructs the well casing, would constitute an important advancement in the art.

SUMMARY OF THE INVENTION

In view of the foregoing factors and conditions characteristic of the prior art, it is a primary objective of the present invention to provide a new and improved retrievable oil well capping device that is particularly advantageously applied to the problem of capping high pressure oil and gas wells that have damaged well head structures. Another objective of the invention is to provide a device that will quickly and economically cap and allow the repair and control of the flow of oil and gas emanating from such wells to materially enhance the quality of the environment of mankind by contributing to the restoration of the basic life-sustaining natural elements—air, water, and soil.

In accordance with an embodiment of the present invention, a retrievable oil well capping device for temporarily obstructing the casing of oil and gas well below the head thereof includes an elongated shaft having an upper end and a lower end, and sealing means including elongate elastomeric material mounted on the shaft for expanding radially outwardly and obstructing a well casing when the material is axially compressed. Also the invention includes compression means mounted on the shaft for axially compressing the elastomeric material and causing an equal well-obstructing force progressively along the material from one end thereof to the other.

Thus, the present invention provides a new approach to contain and control high pressure oil and gas wells that have damaged well head structures, and that is easily movable to a gushing oil well site and disposable thereon to temporarily stop the flow of gas and oil.

BRIEF DESCRIPTION OF THE DRAWINGS

The various features and advantages of the present invention may be more readily understood with reference to the following detailed description taken in conjunction with the accompanying drawings, wherein like reference characters relate to like elements, and in which:

FIG. 1 is a perspective view of an retrievable oil well capping device according to the present invention;

FIG. 3 is an enlarged elevational view, partially in cross section, showing the upper, device-actuation portion, of the invention of FIG. 1;

FIG. 4 is an enlarged perspective view of a portion of a resilient member incorporated in the device of FIG. 1;

FIG. 5 is an enlarged elevational view, partially in section, of a pulley retaining arrangement according to an embodiment of the invention;

FIG. 8 illustrates another embodiment of the invention where the length progression is opposite that shown in FIGS. 1, 2, 6 and 7;

FIG. 9 shows still another embodiment of the present invention, wherein sub-elements are utilized; and FIG. 10 is a perspective view, showing a portion of a elastomeric element constructed in accordance with still another embodiment of the present invention.

DETAILED DESCRIPTION

Figure 2:
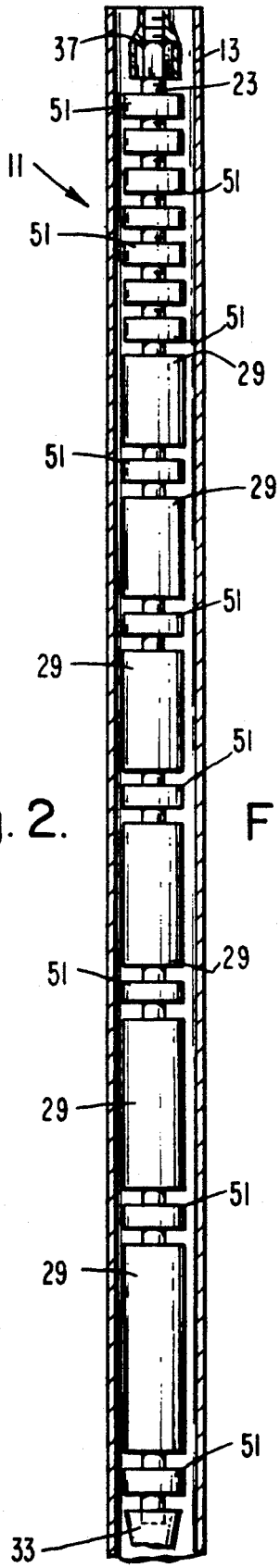
FIG. 2 is an elevational view, partially broken away, of a section of the device of FIG. 1.

Referring now to the drawings and more particularly to FIGS. 1 through 3, there is shown a retrievable oil well capping device 11 for temporarily obstructing the casing 13 of an oil or gas well 15 below the head 17 thereof. The invention includes an elongated shaft 21 having an upper end 23 and a lower end 25, and sealing means 27 including elongate elastomeric material 29 mounted on the shaft 21 for expanding radially outwardly and obstructing the well casing 13 when the material 29 is axially compressed. The invention also includes compression means 31 mounted on the shaft 21 for axially compressing the elastomeric material 29 and causing an equal well-obstructing force progressively along the material 29 from one end thereof to the other.

The shaft 21 may be fabricated from any high strength material such as a steel alloy, and its lower end 25 is fitted with an end piece 33. This end piece is preferably constructed from a solid hardened material such as steel, and shaped to have an elongated downwardly-pointing elongated conical shape (needle nose). This configuration allows the device 11 to be directed more easily into a gushing well, and it is helpful in entering even a somewhat constricted opening in the well head 17.

At an intermediate section of the shaft 21, the shaft is provided with a threaded section 35 threadably engaging an associated high-strength nut 37 having a grippable outer surface such as a hexagonal surface 39. Preferably, the threads are designed to withstand a great amount of pressure, as can be appreciated and fabricated by one skilled in the art.

Extending above the intermediate threaded section 35 is, in this embodiment, an upper hexagonal section 41. Mounted on the shaft 21 between the end piece 33 and the nut 37 are disposed a plurality of the elongate thick resilient elastomeric cylindrical elements 29 separated from each other by stiff, compression equalizing disks 51 of a material such as an aluminum alloy, for example. Also, a plurality of successive disks 51 are mounted on the shaft at the intermediate threaded section 35 of the shaft 21, immediately below the nut 37 in order to effectively prevent the elements 29 from coming into contact with the threaded section 35.

As can best be seen in FIG. 3, the compression means 31 includes an elongated tubular sleeve member 61 having a lower internal socket 63 which slidably fits over and registers with the hexagonal surface 39 of the nut 37, in a manner similar to that of a mechanic's socket wrench coupled to a conventional nut. At the upper end of the member 61 is a bearing housing 65 that fits over and is welded or otherwise affixed to the sleeve. The housing 65 includes an axial hole 67 through which the upper end 23 of the rod 21 extends. Disposed in the housing 65 is a conventional bearing 69 that provides lateral stability for the rod while allowing rotation about the rod's longitudinal axis.

A conventional pulley arrangement 71 is axially slidably mounted on the upper shaft 23, above the bearing housing 65. A conventional steel cable 73 is coupled to (looped about) the pulley 71 and moved linearly by any conventional remotely-located mechanism in order to cause the pulley to rotate in a desired direction. Since the aperture (not shown) coaxial with the axis of the pulley 71 is configured to register with the outer configuration of the upper rod portion 23, any rotation of the pulley will cause rotation of the rod 21. The diameter of the pulley 71 is determined by the lever arm necessary to provide the desired axial compression force, taking into consideration the threaded section configuration, friction, characteristic of the compressible elastomeric elements, etc.

In the preferred embodiment of this invention, the aperture in the pulley is oversized just enough to allow it to move axially along upper rod portion 23 while causing the rod to rotate. In this case, the pulley's aperture would have a hexagonal configuration.

In order to facilitate the lifting and lowering of the capping device 11, an upper nut 75 is threadably or otherwise removably affixed to the upper end 77 of the rod 21. This captures the compression means 31 on the device 11 while inserting the device in and lifting the device from a well.

Attached by welding or otherwise to an intermediate portion of the tubular member 61 is a collar 81 that carries an outwardly extending bracket 83. The outer end of the bracket 83 is provided with an aperture (not shown) that accepts a pivot pin 85 which extends through associated holes 87 adjacent an outer end 89 of a longitudinal member 91 of a center adjusting arm mechanism, generally identified by arrow 93.

Also included in the mechanism 93 is a sleeve 95 which slidably carries the member 91, and a conventional hydraulic cylinder 97 coupled by means not shown to a source of hydraulic fluid under pressure. The cylinder 97 has an axially extendable rod 99 and a fixed tab or mounting bracket 101. As seen in FIG. 1, the rod 99 is coupled to the inner end of the longitudinal member 91, and the bracket 101 is pinned to a downwardly extending bracket 103 fixed to the lower surface of a relatively large diameter (approximately 5 inches) end of a boom portion 105 of a conventional crane or appropriately modified fork lift vehicle. Whatever form the manipulator of the boom portion 105 takes, it should provide a very significant downward force, as can be designed by anyone skilled in the art. Also, the upper side of the sleeve 95 is welded to the underside of the boom 105.

A similar hydraulic cylinder 97, is shown employed on the upper side of the boom 105 and attached (welding, for example) directly to the tubular sleeve member 61. By hydraulically controlling the cylinder's rod 99', the device 11 may be pivoted about the pivot pin 85 in the pivot junction between the bracket 83 and the outer end of the arm mechanism 93. Thus, the lower cylinder 97 along with the upper cylinder 97' adjust the distance the device is located from the end of the boom 105, and additional movement of the actuated rod from the upper cylinder adjusts the angle the longitudinal axis of the device 11 makes with the vertical.

Referring now also to FIG. 4, the elongate cylindrical elastomeric material elements 29 are preferably provided with metallic particles 111 embedded in an outer portion 113 of each element, preferably in a uniform pattern, leaving that portion of each element adjacent an inner bore 115, particle free. The particles 111 may be any hard material such as aluminum oxide or titanium oxide, for example.

The elastomeric material used is not critical, and may be rubber or conventional plastic, for example. However, the material must be adapted to withstand the environment to which it is subjected and be able to uniformly expand outwardly (bulge) with compressive axial forces applied thereto. Generally, the material should be relatively hard, not spongy, and oil-resistant.

An important characteristic of each of these elements is that with the same axial compressive force applied to successive ones of the elements, the axially longer elements will radially expand before the shorter ones.

In operation, the capping device 11, is directed into the opening in the well head 17 and down to a desired depth where the radially expandable portion thereof is below the damaged portion of the well head, by the use of the hydraulically operated boom 105. The pivot 85 and the hydraulic cylinders aid in the proper orientation of the device 11, and the elongated conical end piece 33 aids in overcoming the intense force of the fluid emanating from a high pressure well.

Once in place, the cable 73 is linearly moved to turn the pulley 71 in a direction to cause the rotation of the rod in a direction relative to the direction of the threads in the nut 37 so that the rod moves upward relative to the nut 37. The nut is prevented from rotating by the operation of the removable tubular sleeve member 61 and its socket portion 63. The sleeve member itself is kept from rotating by the collar 81 attached through the bracket 83 and the mechanism 93 to the boom 105.

As the rod 21 moves upward, the pulley 71 slides downward on the hexagonal-shaped upper rod end 23. This may be facilitated by the use of an inverted square U-shaped bracket (not shown) attached at its bottom to the member 61. The bracket may have a hole at its apex which accommodates the shaft 21 and traps the pulley 71 adjacent the top of the bearing housing 65. Preferably, the pulley 71 is maintained in a fixed position relative to the top of the bearing housing 65 by a pulley bearing/bracket assembly 121.

FIG. 5 illustrates the assembly 121. Here, the pulley 71 is fixedly attached to a coaxial flanged-tube member 123 that is threaded, for example, at its lower end to a conventional thrust bearing 125. In turn, the bearing 125 is captured in an appropriate annular flange cap 127 welded or otherwise permanently attached to the top of the bearing housing 65.

The rotation of the rod 21 causes the lessening of the distance between end piece 33 and the nut 37. This provides a compression force on the elements 29 mounted on the rod 21. Before the compressive force is applied by the shaft rotation, the elastomeric material elements 29 and the compression equalizing disks 51 are loosely distributed and adjacent each other on the shaft 21. The spacing between these elements shown in FIG. 2 is only for illustration of the shape of these elements prior to compression.

At this point, it should be noted that the lengths of the elastomeric material elements 29 are not equal. In fact, it is by design that each such element 29 is defined by the length of the elastomeric material between the compression equalizing disks 51. It is also by design that these elements are progressively shorter, starting at one end of these elements and moving to the other end thereof.

It is a characteristic of these elastomeric material elements that the longer ones of these elements expand radially outwardly before the shorter ones when they are axially compressed by the same amount of compressive force. Thus, a longer element 29 will expand to engage the inner wall of the casing 13 before an adjacent shorter element. This progressive radial expansion action is assured by the use of the compression equalizing disks 51 disposed between the elements 29.

Figure 6:
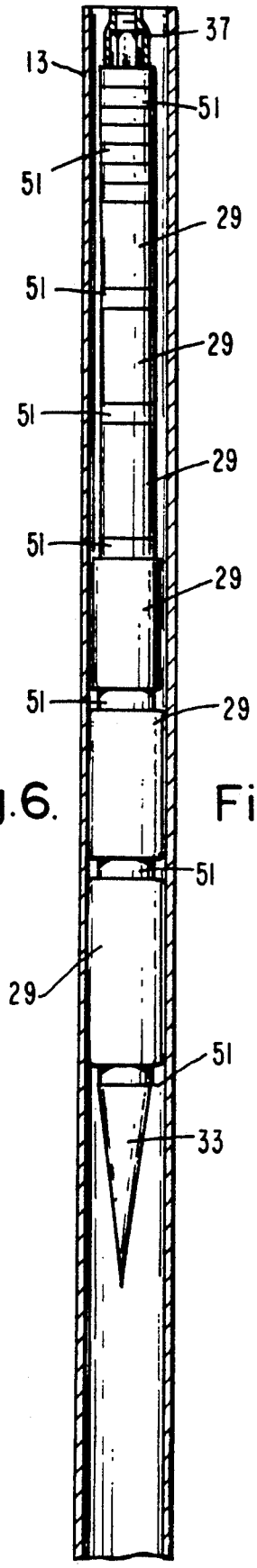
FIG. 6 is an elevational view, partially in cross section, of the lower portion of the device of FIG. 1, showing the beginning of well obstruction by the device.

FIG. 6 illustrates the progressive action noted above. Here, in this embodiment of the invention, the longest (lowest) element 29 has expanded to engage the inner casing wall, while the next element above it is just beginning to do the same. At this point, the remaining elements 29, although the same compressive axial force is applied to all elastomeric material elements, have not expanded to a significant degree.

Figure 7:
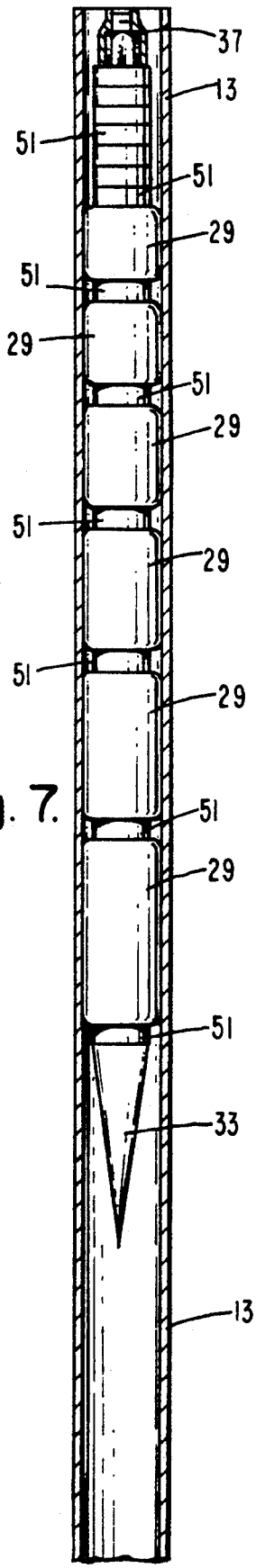
FIG. 7 illustrates the final stage of well obstruction of the device of FIG. 6.

With more compressive axial force applied by continued rotation of the pulley 71, the next higher (shorter) element 29 will expand enough to contact the casing wall until, finally, all such elements press on the casing to assure complete obstruction of the casing 13, as shown in FIG. 7.

The progressive application of such radially expanding pressure by the successive elements helps to prevent damage to the casing. This is very important since such casing damage can permanently prevent the well from ever being used again. That would require a very expensive and time consuming process of drilling a new well.

In this embodiment, where the lowest elastomeric material element 29 is the axially longest of the series of such elements, continued rotation of the rod 21 will cause the nut 37 to move downward relative to the end piece 33 since the lowest element will always be the first to anchor itself in the casing 13. This requires that the compression means 31 be forced downward to the same extent in order to keep the socket portion of the member 61 engaging the nut 37.

In an alternate embodiment of the invention, shown in FIG. 8, the elastomeric material elements 29 are disposed in an opposite progression relative to length, that is, the longest element 29 is located at the top, and the shortest element is at the bottom. Here, the nut 37 and the compression means 31 will move upward relative to the well head with "compression" rotation of the pulley 71 since the upper elastomeric material element will anchor to the well casing first.

Once the well is completely obstructed, the upper nut 75 may be removed so that the compression structure 31 may be lifted up and away from the area. This will allow workmen to repair or replace the damaged well head area and possibly install a multiple valve fixture such as what is known as a "Christmas Tree", for example.

The diameter dimension of the elastomeric material elements will depend upon the diameter of the well casing to be obstructed, taking into consideration the amount of radial expansion each elastomeric element is capable of under normal axial compression forces produced by the device.

After completion of the repair and/or replacement operation, the compression means 31 and retaining nut 75 are replaced in order to allow the pulley 71 to be rotated in the opposite direction by the cable 73, which causes the rod 21 to move downward relative to the nut 37 and lessen the compressive force on the elastomeric elements. The device 11 can then be easily lifted from the well by movement of the boom 105.

Although the elements 29 are shown to have different lengths, it should be recognized that each such element 29 may be, in fact, comprised of plurality of fixed-length shorter sub-elements, for example. Thus, the longest element 29, shown in FIG. 9, would be comprised of more of such shorter fixed-length sub-elements 29' than the element 29 adjacent to it, each complete element 29 being separated by a compression equalizing disk 51. Again, it is important to note that the compression equalizing disks 51 define the relative length of each element 29.

Although detailed descriptions have been given with respect to several embodiments of the present invention, it should be understood that dimension and materials other than those herein specified may be used to perform the same function. For example, the elastomeric elements 29 with their embedded particles 111 may be replaced by an elastomeric element 121 having a more or less uniform pattern of "L"-shaped steel wires 123, as illustrated in FIG. 10, for example. The wires 123 have a shorter bent portion 125 that lies on the outer surface of the element 121, and a longer element-embedded portion 127. The bent portion 125 will lie parallel to the axis of the shaft 21 and point away from the direction of insertion of the device in a well casing. Also, depending upon the material used in the elements 29 and 121, and the well casing diameter and other such factors, the section of the device below the threaded portion may be about 10 to 12 feet long, and the device may have an overall length of about 17 to 20 feet.

From the foregoing, it should be obvious that there has herein been described a new and improved retrievable oil and gas well capping device that is easily constructed, economical to build, easy to transport, assemble and operate, and very quick and effective in operation. Although several embodiments of the invention have been described in detail, again, it should be understood that additional embodiments and arrangements can be readily devised by those skilled in the art without departing from the scope of the invention.

What is claimed is:

1. A retrievable oil well capping device for temporarily obstructing the casing of oil and gas wells below the head thereof, comprising;

a rotatable elongated shaft having an upper end and a lower end;

sealing means including elongate elastomeric material mounted on said shaft for expanding radially outwardly and obstructing a well casing when said material is axially compressed; and compression means mounted on said shaft for axially compressing said elastomeric material and causing an equal well-obstructing force progressively along said material from one end thereof to the other.

2. The retrievable oil well capping device of claim 1, wherein said shaft includes an intermediate threaded portion, and wherein said compression means includes a threaded nut member threadably engaging said threaded portion of said elongated shaft.

3. The retrievable oil well capping device of claim 1, wherein said elongated shaft includes a downwardly pointing conical end piece at said lower end of said shaft.

4. The retrievable oil well capping device of claim 3, wherein said end piece has a needle-nose configuration.

5. The retrievable oil well capping device of claim 1, wherein said compression means includes a shaft rotating structure, and wherein said elongated shaft includes an upper grippable portion to which is keyed said shaft rotating structure axially movable along said shaft.

6. The retrievable oil well capping device of claim 5, wherein said upper grippable portion of said elongated shaft has a hexagonal cross section, and wherein said shaft rotating structure includes a pulley having a hexagonal axial opening therethrough axially slidably registering with said upper grippable portion of said elongated shaft.

7. The retrievable oil well capping device of claim 6, wherein said compression means also includes remotely movable cable means coupled to said pulley for rotating said pulley in one direction to increase said axial compression, and for rotating said pulley in the opposite direction for decreasing said axial compression.

8. The retrievable oil well capping device of claim 1, wherein said elongate elastomeric material is cylindrical in shape.

9. The retrievable oil well capping device of claim 1, wherein said sealing means includes a plurality of cylindrical segments of said elongate elastomeric material mounted on said elongated shaft, and wherein said compression means includes at least one compression equalizing annular disk slidably mounted on said elongated shaft and disposed between each of said segments of said elastomeric material.

10. The retrievable oil well capping device of claim 9, wherein said compression means includes elastomeric material protection means mounted on said elongated shaft for preventing said elastomeric material from contacting said threaded portion of said elongated shaft.

11. The retrievable oil well capping device of claim 10, wherein said elastomeric protection means includes a plurality of said compression equalizing annular disks.

12. The retrievable oil well capping device of claim 1, wherein said elongate elastomeric material includes relatively hard particles embedded in an outer portion thereof.

13. The retrievable oil well capping device of claim 12, wherein said particles do not extend to the surface area of said elastomeric material adjacent said elongated shaft.

14. The retrievable oil well capping device of claim 12, wherein said particles are of aluminum oxide.

15. The retrievable oil well capping device of claim 12, wherein said particles are of titanium oxide.

16. The retrievable oil well capping device of claim 1, wherein said elastomeric material is comprised of relatively hard rubber.

17. The retrievable oil well capping device of claim 1, wherein said elastomeric material is comprised of a plastic material.

18. The retrievable oil well capping device of claim 9, wherein said cylindrical segments of said elastomeric material are not of the same length.

19. The retrievable oil well capping device of claim 18, wherein said cylindrical segments of said elastomeric material are of progressively longer length from said lower end of said elongated shaft toward said upper end thereof.

20. The retrievable oil well capping device of claim 18, wherein said cylindrical segments of said elastomeric material are of progressively shorter length from said lower end of said elongated shaft toward said upper end thereof.

21. The retrievable oil well capping device of claim 9, wherein said cylindrical segments comprise a plurality of axially shorter cylindrical sub-segments.

22. The retrievable oil well capping device of claim 21, wherein all of said sub-segments are of approximately the same axial length.

23. The retrievable oil well capping device of claim 2, wherein said compression means includes nut-gripping means removablly registerable with said nut member for preventing rotation of said nut member when said elongated shaft is rotated.

24. The retrievable oil well capping device of claim 23, wherein said nut-gripping means includes an elongated tubular member having a lower, nut-engagable, socket end portion.

25. The retrievable oil well capping device of claim 24, wherein said nut-gripping means includes an upper-shaft stabilizing bearing mounted adjacent the upper end of said elongated tubular member.

26. The retrievable oil well capping device of claim 1, also comprising device placement means coupled below said upper end of said elongated shaft for inserting said device in and removing said device from the well casing.

27. The retrievable oil well capping device of claim 26, wherein said device placement means includes a boom-supportable linearly extendable hydraulic cylinder mechanism for moving and orienting said device with respect to the oil well casing.

28. The retrievable oil well capping device of claim 27, wherein said device placement means also includes a boom-supportable tiltable, device-tiltable hydraulic cylinder mechanism for angularly orienting the elongated axis of said device relative to the elongate axis of the well casing.

29. The retrievable oil well capping device of claim 1, wherein said elongate elastomeric material includes a plurality of L-shaped wires having their longer shank portions embedded in said material and their shorter bent portions lying on the outer surface of said material.

30. The retrievable oil well capping device of claim 29, wherein said shorter bent portions of said L-shaped wires extent from said shank portions in a direction parallel to the elongated axis of said shaft and toward said upper end thereof.

* * * * *